US006178950B1

(12) United States Patent
Stockner et al.

(10) Patent No.: US 6,178,950 B1
(45) **Date of Patent: *Jan. 30, 2001**

(54) NOISE REDUCING BRACKET FOR A FUEL INJECTION SYSTEM

(75) Inventors: Alan R. Stockner, Metamora, IL (US); Mike Youakim, Milwaukee, WI (US)

(73) Assignee: Caterpillar Inc., Peoria, IL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/896,796

(22) Filed: Jul. 18, 1997

Related U.S. Application Data

(63) Continuation-in-part of application No. 08/872,864, filed on Jun. 11, 1997, now Pat. No. 5,752,487.

(51) Int. Cl.[7] ..... F02M 55/02
(52) U.S. Cl. ..... 123/470; 123/469
(58) Field of Search ..... 123/470, 469, 123/468, 509, 456

(56) References Cited

U.S. PATENT DOCUMENTS

| | | | | |
|---|---|---|---|---|
| 3,227,147 | | 1/1966 | Gossiaux | 123/139 |
| 3,788,287 | * | 1/1974 | Falen | 123/470 |
| 4,235,375 | * | 11/1980 | Melotti | 123/470 |
| 4,240,384 | * | 12/1980 | Urbinati | 123/470 |
| 4,327,690 | | 5/1982 | Sauer et al. | 123/469 |
| 4,416,238 | | 11/1983 | Knapp et al. | 123/470 |
| 4,485,790 | | 12/1984 | Nishimura et al. | 123/468 |
| 4,901,700 | | 2/1990 | Knight et al. | 123/470 |
| 5,044,738 | * | 9/1991 | Shelton | 123/469 |
| 5,046,469 | | 9/1991 | Gmelin | 123/470 |
| 5,226,391 | | 7/1993 | Gras et al. | 123/456 |
| 5,280,774 | | 1/1994 | Entenmann et al. | 123/457 |
| 5,392,749 | | 2/1995 | Stockner et al. | 123/470 |
| 5,398,656 | | 3/1995 | Brisbane et al. | 123/470 |
| 5,503,128 | * | 4/1996 | Hickey | 123/470 |
| 5,682,857 | * | 11/1997 | Briggs | 123/469 |
| 5,718,205 | * | 2/1998 | Jo | 123/470 |
| 5,735,247 | * | 4/1998 | Tsuzuki | 123/470 |
| 5,752,487 | * | 5/1998 | Harrell | 123/470 |

FOREIGN PATENT DOCUMENTS

| | | | | |
|---|---|---|---|---|
| 2020677 | * | 10/1977 | (DE) | 123/469 |
| 2177157 | * | 1/1987 | (GB) | 123/470 |

* cited by examiner

*Primary Examiner*—Carl S. Miller
(74) *Attorney, Agent, or Firm*—Michael B. McNeil

(57) ABSTRACT

A noise reducing fuel injection system includes an engine having a head with an injector bore. A fuel injector is suspended in the injector bore via a noise reducing mounting bracket. The mounting bracket has a clamping portion that clamps to the fuel injector, a support that is attached to the engine and an arm portion extending between the clamping portion and the support. The fuel injector is allowed to slide a slight distance in and out of the injector bore when the engine is running by either making the arm portions slightly flexible, by including resilient members between the support and the engine, or both.

19 Claims, 5 Drawing Sheets

NOISE REDUCING BRACKET FOR A FUEL INJECTION SYSTEM

RELATION TO A PRIOR APPLICATION

This application is a continuation-in-part of application Ser. No. 08/872,864, filed on Jun. 11, 1997, now U.S. Pat. No. 5,752,487.

TECHNICAL FIELD

The present invention relates generally to brackets for mounting a fuel injector on an engine, and more particularly to a noise reducing bracket for mounting fuel injectors on an engine.

BACKGROUND ART

Engineers are often looking for ways to reduce noise in internal combustion engines. In the case of diesel type engines, one known source of engine noise results from operation of the fuel injection system. Most fuel injectors include several moving components, such as valve members, that come into contact with other injector components at relatively high speeds creating noise. This noise is transferred to the engine since the injector is typically clamped rigidly into an injector bore made in the head of the engine. As an example, the poppet control valve member of a hydraulically actuated fuel injector creates undesirable noise whenever the member is brought to an abrupt stop when it contacts a valve seat. This undesirable noise is transferred to the engine due to the substantially rigid mounting of the injector to the engine head.

The present invention is directed toward reducing noise in an engine that is produced during operation of a fuel injection system.

DISCLOSURE OF THE INVENTION

A noise reducing fuel injection system includes an engine having a head with a first injector bore. A first fuel injector is suspended in the injector bore with a mounting bracket. The mounting bracket has a first clamping portion separated from a support by a first arm portion. The first clamping portion is clamped to the first fuel injector. The support is attached to the head of the engine. The first fuel injector is capable of sliding a slight distance in and out of the first injector bore when the engine is running. One method of accomplishing this sliding is to make the first arm portion slightly flexible so that the injector can slide in and out of the injector bore when the engine is running.

In another embodiment of the present invention, a fuel injector mounting bracket includes a support. A first clamping portion sized to be clamped to a first fuel injector is attached to the support via a first arm. A second clamping portion that is sized to be clamped to a second fuel injector is attached to the support via a second arm that is positioned on the opposite side of the support from the first arm.

BEST MODE FOR CARRYING OUT THE INVENTION

Figure 1:
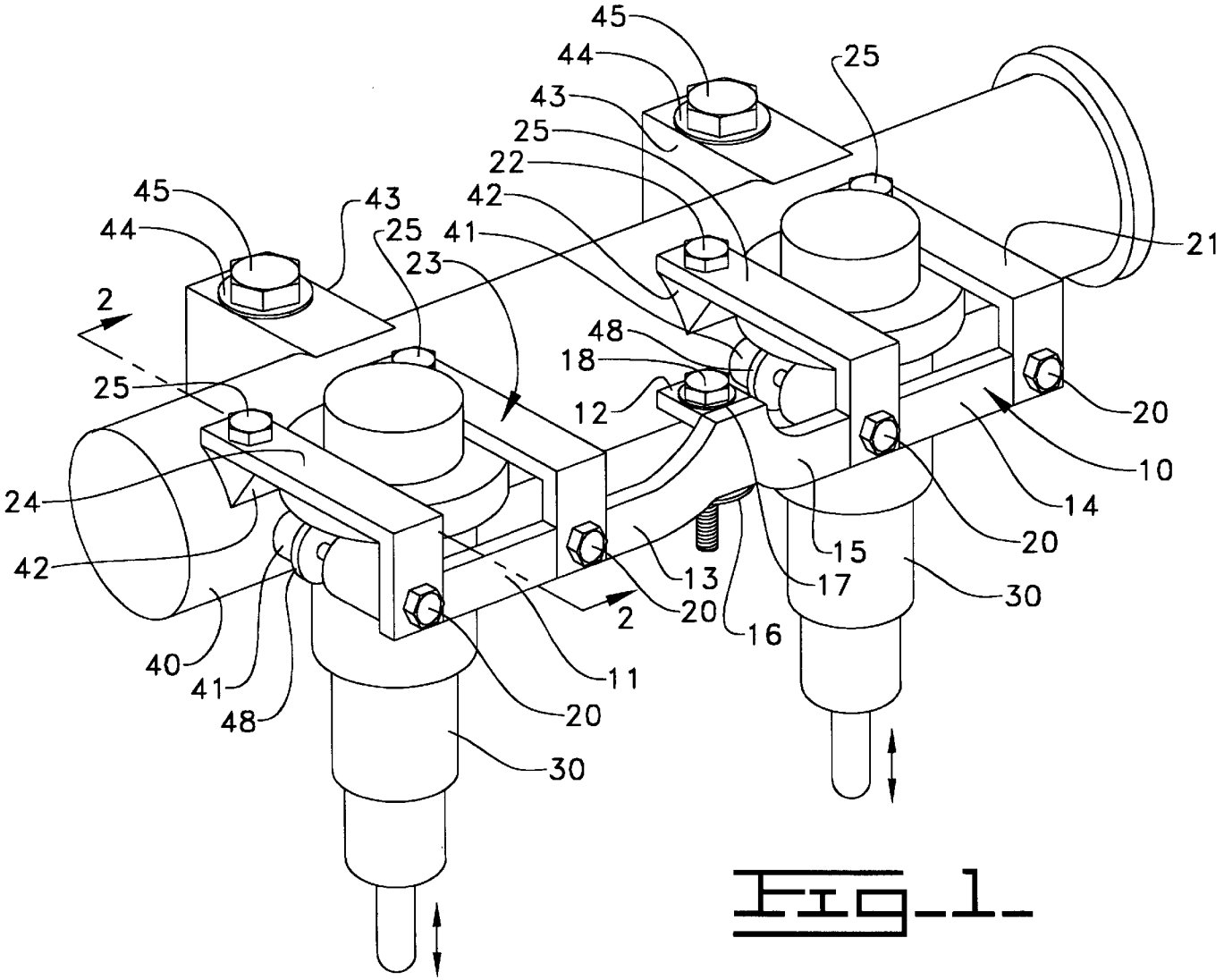
FIG. 1 is an isometric view of a noise reducing fuel injection system according to one embodiment of the present invention.
Figure 2:
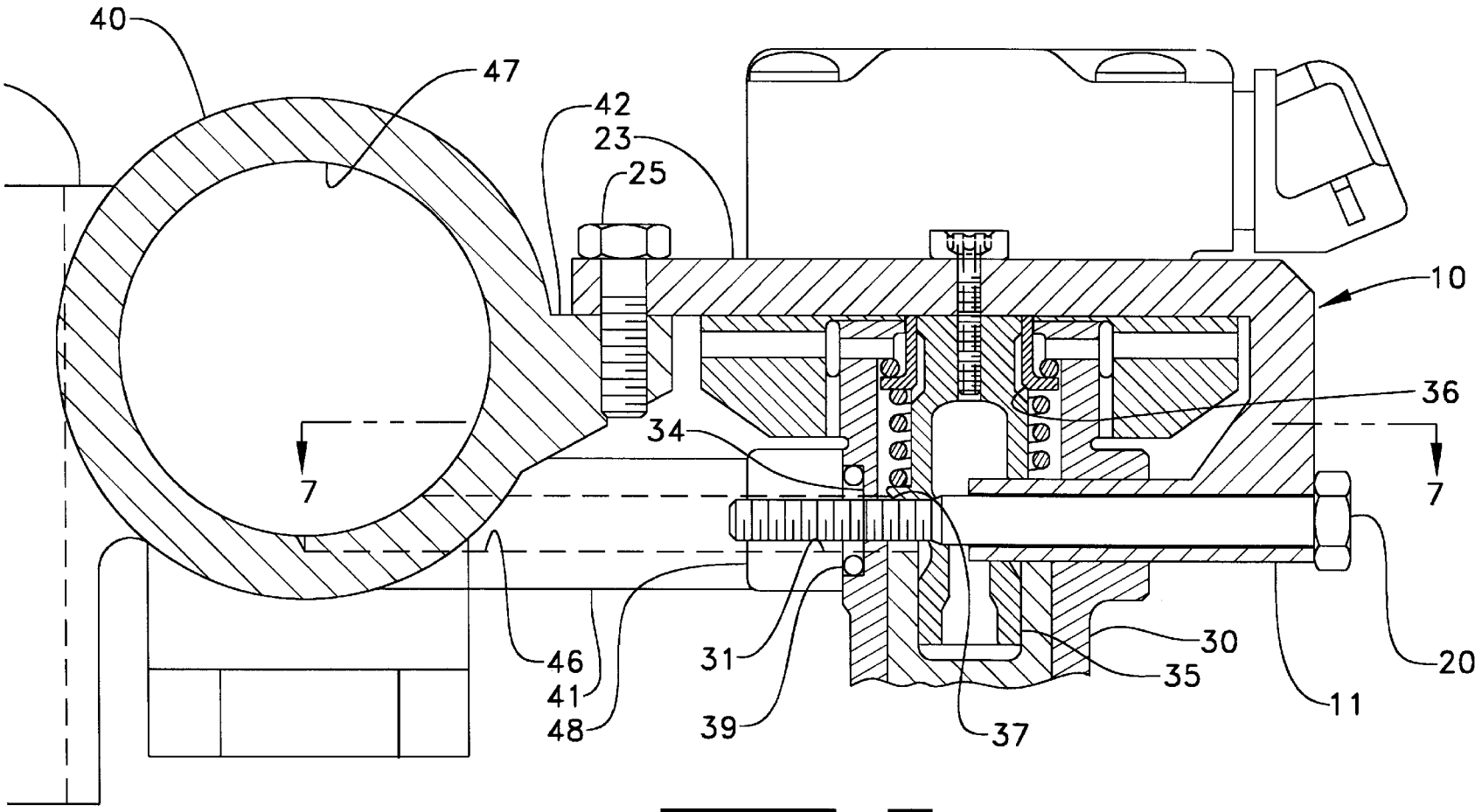
FIG. 2 is a partial sectioned side elevational view of the noise reducing fuel injection system of FIG. 1 as viewed along section lines 2—2 of FIG. 1.

Referring now to FIGS. 1 and 2, a noise reducing fuel injection system includes a pair of hydraulically actuated fuel injectors 30 that are connected to an actuation fluid common rail 40 and to an engine via a noise reducing bracket 10. Noise reducing bracket 10 includes a support 12 that is attached to an engine via a conventional fastener, such as a bolt 18. However, bracket 10 is vibrationally isolated from the engine (not shown) by a pair of washers 16 and 17, which are made from a suitable resilient material. Washers 16 and 17 could also be one or more bellville type washers. Washer 17 is positioned between support 12 and bolt 18, whereas washer 16 is positioned between support 12 and the engine head. In addition to support 12, noise reducing bracket 10 includes a first clamping portion 11 separated from support 12 by a first arm portion 13, and a second clamping portion 14 separated from support 12 by a second arm portion 15. Arms 13 and 15 are preferably positioned on opposite sides of support 12.

Figure 7:
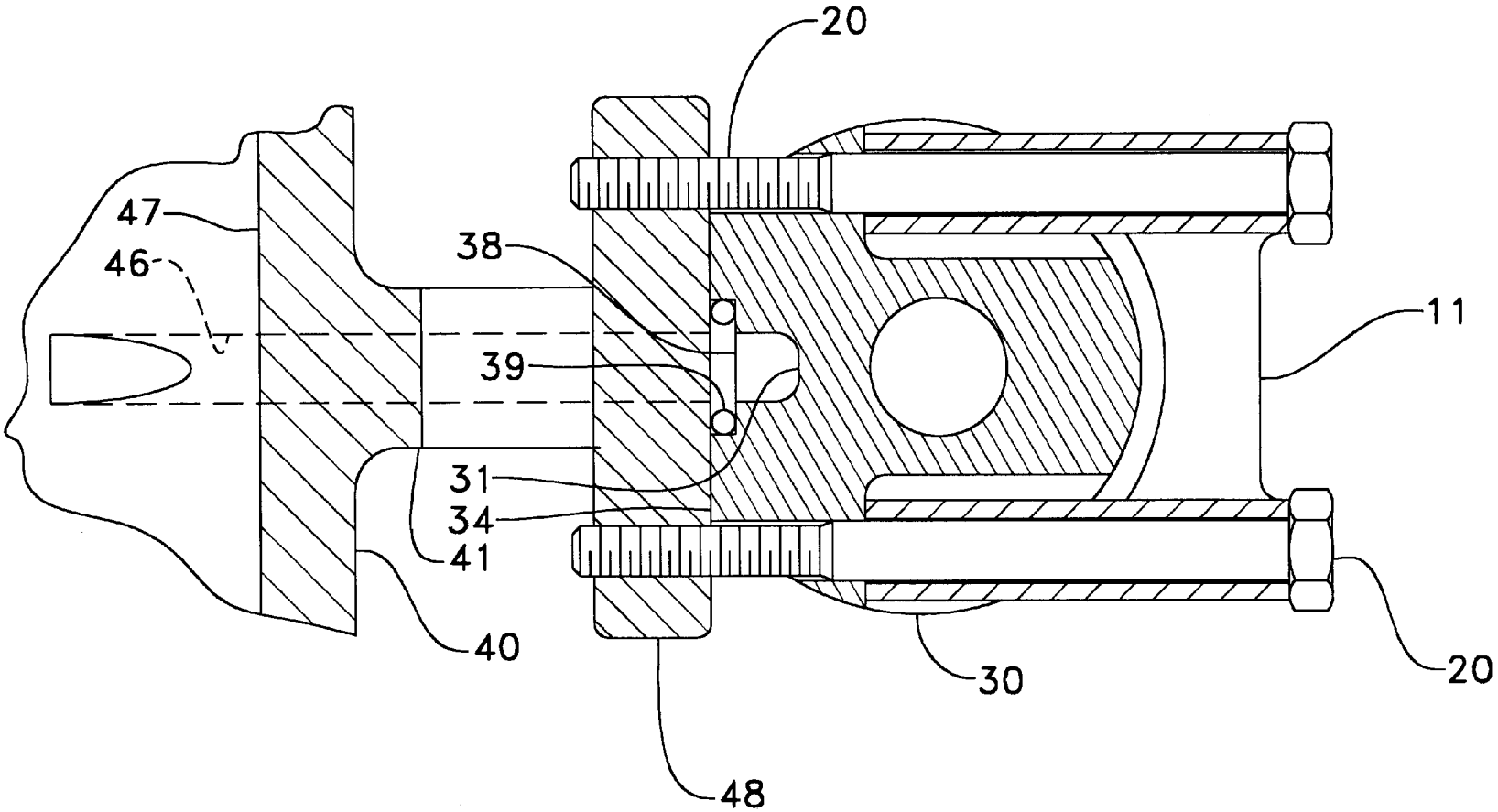
FIG. 7 is a partial sectioned top view of the noise reducing fuel injection system of FIGS. 1 and 2 as viewed along section lines 7—7 of FIG. 2.

Clamping portions 11 and 14 are each clamped to a respective fuel injector 30 via a pair of bolts 20 that are received in threaded openings in supply pipe flange 48 of supply pipe 41 (see FIG. 7). In this way, a portion of the fuel injector body is surrounded and held in a substantially rigid position with respect to noise reducing bracket 10. The clamp load is preferably applied through the centerline of the injector in order to avoid distortion of injector components. In referring to FIGS. 2 and 7, supply pipe flange 48 also serves as a means by which a supply pipe 41 is connected to the actuation fluid inlet 31 of fuel injector 30. Injector 30 includes a flat surface 34 against which supply pipe flange 48 abuts (see FIG. 7). A "D"-ring 39, which is positioned in inlet counter bore 38, prevents leakage when supply pipe 41 is mated to clamping portion 11. Thus, high pressure actuation fluid (preferably oil, which is different from the fuel fluid) that is stored within chamber 47 of common fluid rail 40 is supplied through a passage 46 to the high pressure actuation fluid inlet 31 of each respective fuel injector 30. In order to further rigidify and couple the mass of fuel injectors 30 with common rail 40, each clamping portion 11 and 14 include over the top extensions 21–24. Extensions 21–24 are rigidly attached to fluid rail 40 at mounts 42 via conventional bolts 25. Thus, noise reducing bracket 10 serves as both the means by which the actuation fluid inlet of injectors 30 are connected to fluid rail 40 and also the means by which the mass of fluid rail 40 is coupled to that of the injectors.

Common fluid rail 40 is attached to the engine via mounts 43 and conventional fasteners, such as bolts 45. However, like support 12 of noise reducing bracket 10, fluid rail 40 is isolated from the engine by positioning resilient washers 44 between bolt 45 and mounts 43. Washers 44 could also be bellville type washers. Additional resilient or bellville washers, which cannot be seen, are preferably positioned between mounts 43 and the engine head.

By utilizing resilient washers between mounting bracket 10 and common fluid rail 40, the combined mass of fuel injectors 30 and fluid rail 40 is isolated from the engine. Furthermore, the substantially rigid connection between clamping portions 11 and 14 with fluid rail 40 serves to increase the effective mass of each fuel injector 30. Referring again to FIG. 2, when poppet valve member 35 is moved between seats 36 and 37, noise is produced within injector 30. However, because the mass of the injectors is combined with fluid rail 40, a greater amount of mass is available to absorb the impulse of poppet valve member 35 hitting its respective seats. Because mounting bracket 10 essentially allows fuel injectors 30 to be suspended within respective injector bores 6 within the engine head 5 (FIG. 6), rather than being bolted directly to the head as in the prior art, less vibrational impulses produced within injectors 30 are transferred to the engine. The noise reducing goals of the present invention are further accomplished by giving arm portions 13 and 15 a combination of flexibility and stiffness that allows injectors 30 to move up and down a slight distance when the engine is running. This slight distance would of course vary depending upon the size of the engine, the magnitude of the vibration to be considered, and other factors, but is preferably less than about 0.2 millimeters.

Figure 6:
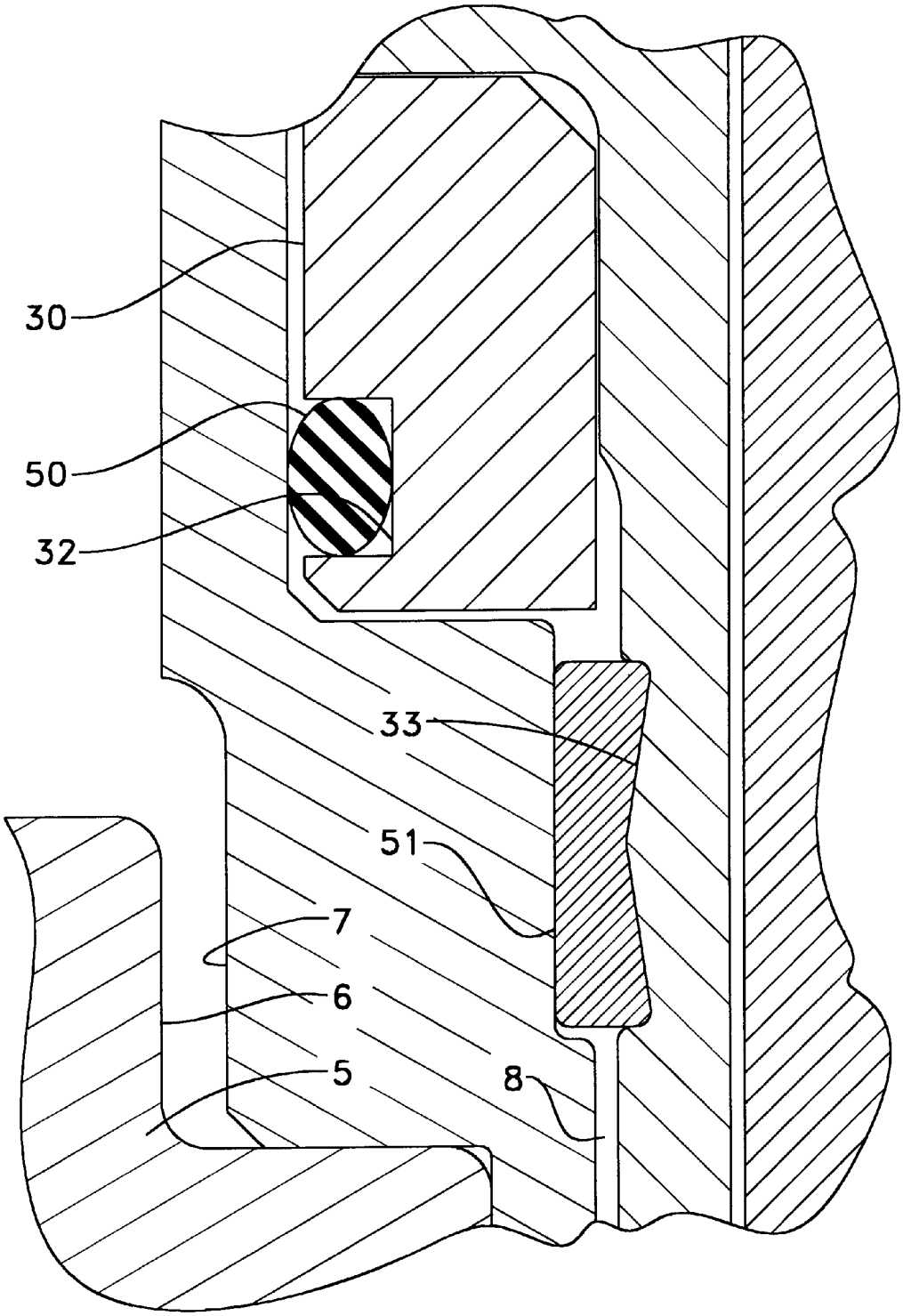
FIG. 6 is a partial sectioned side elevational view of an engine head with a fuel injector mounted therein according to one aspect of the present invention.

Referring now to FIG. 6, because injectors 30 are suspended within injector bores 6 made in engine head 5 via mounting bracket 10, it is important that the combustion chamber of the engine be adequately sealed against the escape of combustion gases via annular passage 8, which corresponds to the area between the tip of injector 30 and a conventional sleeve that is received within injector bore 6. In the present case, adequate sealing is accomplished by including two sealing rings 50 and 51 around the outer surface of injector 30. Lower sealing ring 51 is preferably a carbon dam that has the ability to withstand the high temperatures and pressures produced within the combustion chamber of the engine. Carbon dam 51 has a cross sectional shape as shown in FIG. 6, is preferably made from a tetraflouroethylene polymer and is received in and held in place in an indentation 33 made in the side of tip surface of injector 30. Further sealing is accomplished by including a conventional o-ring seal 50, which is preferably made from a suitable resilient material, positioned in indentation 32 above carbon dam 51.

Figure 3:
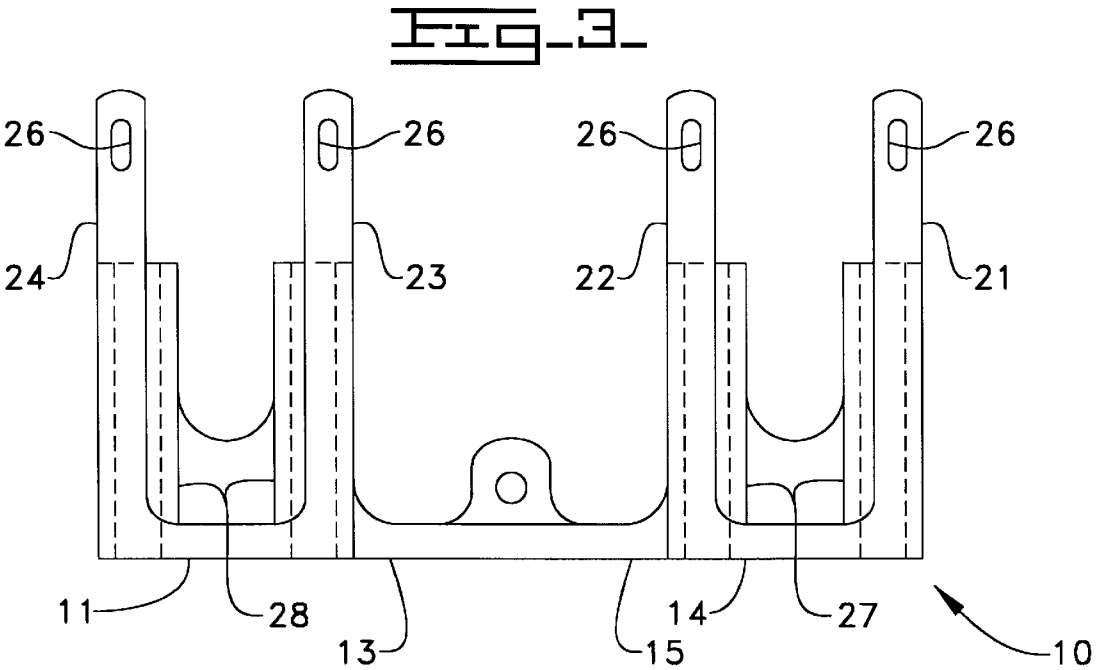
FIG. 3 is a top view of the noise reducing fuel injector mounting bracket according to the present invention.
Figure 5:
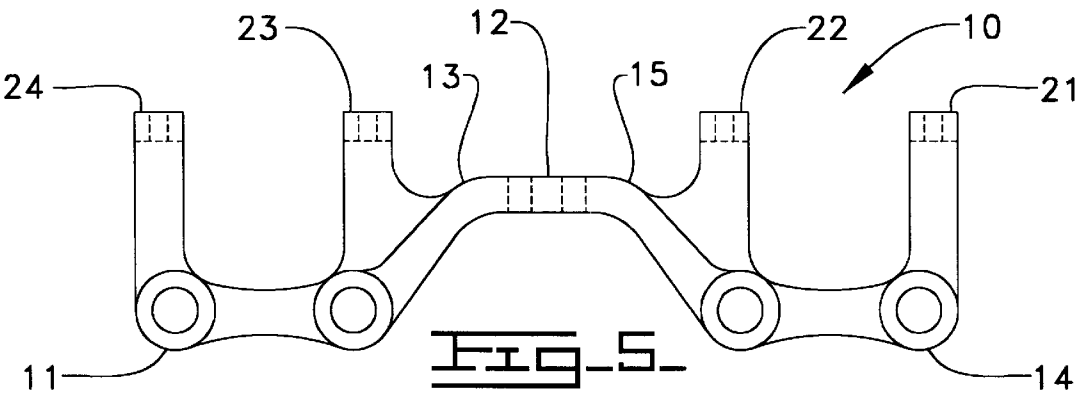
FIG. 5 is a front elevational view of the noise reducing mounting bracket shown in FIGS. 3 and 4.
Figure 4:
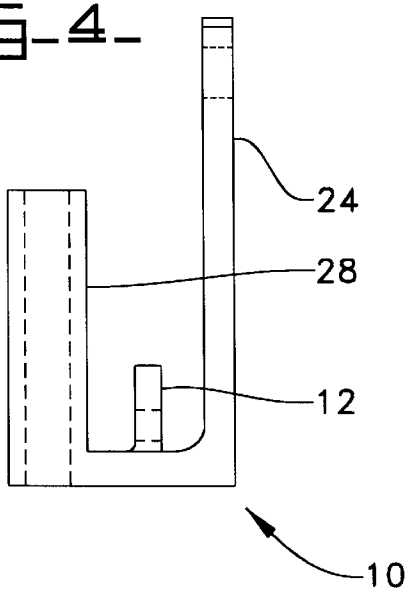
FIG. 4 is a side view of a noise reducing mounting bracket shown in FIG. 3.

Referring now to FIGS. 3, 4 and 5, three orthogonal views of a noise reducing mounting bracket 10 are illustrated. Bracket 10 is preferably formed from a single solid piece of a suitable metallic alloy. As stated earlier, bracket 10 includes a support 12 with a pair of arms 13 and 15 projecting in opposite directions. A pair of clamping portions 11 and 14 are attached on opposing ends of arms 13 and 15. Clamping portion 11 includes a pair of bolt extensions 28 that aid in surrounding an injector received in clamping portion 11 and serves as the means through which bolts may be passed therethrough for attachment to supply pipe flanges 48. Clamping portion 14 is a substantially identical mirror shape of clamping portion 11 and includes bolt extensions 27.

The over the top extensions 21–24 include slotted openings 26 in order to avoid tolerancing problems when bracket 10, injectors 30 and fluid rail 40 are assembled as shown in FIG. 1. By appropriately sizing and shaping arms 13 and 15, the precise amount of rigidity and flexibility can be provided for any given application. For instance, those systems having relatively small injectors and lighter fluid rails could utilize less material in areas in arms portions 13 and 15 and provide the same amount of flexibility as a larger version made to accommodate large injectors and heavier fluid rails while maintaining the ability of the injectors to move in and out of their injector bores.

INDUSTRIAL APPLICABILITY

Although the present invention has been illustrated for use with hydraulically actuated fuel injectors having a poppet control valve member, the principles of the present invention could also be applied to virtually any fuel injector, including cam driven fuel injectors. In other words, since virtually all fuel injectors include a needle valve member near its tip that moves up and down, and hits a back stop, the present invention could also be utilized to reduce noise caused by the needle valve member of virtually any type of fuel injector.

Those skilled in the art will also appreciate that a precise amount of damping and flexibility can be provided in the system by choosing appropriate material and sized resilient washers that are positioned between the fuel injection system and the engine as well as by providing a pre-determined amount of flexibility in the respective arms 13 and 15 of mounting bracket 10. It should also be appreciated that the added damping and flexibility provided by the resilient washers of the present invention could be eliminated without sacrificing the flexibility improvements accomplished by the flexibility of arm portions 13 and 15. In other words, some advantages according to the present invention would still be retained by eliminating the resilient washers while retaining the flexibility arm portions 13 and 15. Likewise, some advantage of the present invention could also be accomplished by making arms portions 13 and 15 substantially rigid while retaining the resilient washer member separation between the fuel injection system and the engine. In other words, because the resilient washers would inherently allow some movement of the fuel injection system with respect to the engine, some of the advantages of the present invention could be achieved by making the mounting brackets substantially rigid, as opposed to being flexible as in the preferred embodiment.

The mounting bracket 10 of the present invention is preferably made for mounting a pair of injectors rather than a single injector or three or more injectors to an engine. This configuration is chosen in order to preferably minimize potential tolerancing problems that could occur when the complete fuel injection system is mated to an engine. Nevertheless, a mounting bracket suitable for a single injector having a single arm portion could accomplish the goals of the present invention. Likewise, an appropriate mounting bracket for three or more fuel injectors could also be utilized without departing on the contemplated scope of the present invention.

It should be understood that the above description is intended for illustrative purposes only, and is not intended to limit the scope of the present invention in any way. Those skilled in the art will appreciate that the present invention, especially the shape of mounting bracket 10, can come in a wide variety of shapes and sizes and still accomplish the noise reducing goals of the present invention. For instance, the arms of the bracket could be made up of a plurality of members rather than a single member as in the preferred embodiment. In any event, the scope of the present invention should be determined in terms of the claims set forth below.

We claim:

1. A noise reducing fuel injection system comprising:

an engine having a head with a first injector bore;

a mounting bracket having a first clamping portion separated from a support by a first arm portion, and said support being attached to said head of said engine;

a first fuel injector;

said first clamping portion being clamped to said first fuel injector in a position such that said first fuel injector is suspended in said first injector bore and capable of sliding a slight distance in and out of said first injector bore when said engine is running.

2. The noise reducing fuel injection system of claim 1 wherein said first arm portion being sufficiently flexible that said first fuel injector can slide a portion of said slight distance in and out of said first injector bore when said engine is running.

3. The noise reducing fuel injection system of claim 1 wherein a first resilient member positioned between said head and said support is sufficiently resilient that said first fuel injector can slide a portion of said slight distance in and out of said first injector bore when said engine is running.

4. The noise reducing fuel injection system of claim 3 wherein said support is attached to said head with a fastener; and a second resilient member positioned between said fastener and said support.

5. The noise reducing fuel injection system of claim 1 wherein said slight distance is less than about 0.2 millimeters.

6. The noise reducing fuel injection system of claim 1 further comprising at least one ring seal separating said first fuel injector from said head within said first injector bore.

7. The noise reducing fuel injection system of claim 6 wherein said at least one ring seal includes a carbon dam.

8. A noise reducing fuel injection system comprising:

an engine having a head with a first injector bore;

a mounting bracket having a first clamping portion separated from a support by a first arm portion, and said support being attached to said head of said engine;

a first fuel injector;

said first clamping portion being clamped to said first fuel injector in a position such that said first fuel injector is suspended in said first injector bore and capable of sliding a slight distance in and out of said first injector bore when said engine is running a fluid rail with a supply pipe attached to said first fuel injector with said first clamping portion;

said mounting bracket being attached to said fluid rail; and said fluid rail being attached to said head of said engine, but being isolated from said head by at least one resilient member.

9. The noise reducing fuel injection system of claim 8 wherein said first fuel injector is a hydraulically actuated fuel injector with an actuation fluid inlet open to said supply pipe; and said fluid rail is a common fluid rail containing an actuation fluid, which is different from fuel, at a relatively high pressure.

10. A noise reducing fuel injection system comprising:

an engine having a head with a first injector bore;

a mounting bracket having a first clamping portion separated from a support by a first arm portion, and said support being attached to said head of said engine;

a first fuel injector;

said first clamping portion being clamped to said first fuel injector in a position such that said first fuel injector is suspended in said first injector bore and capable of sliding a slight distance in and out of said first injector bore when said engine is running;

said head has a second injector bore;

said mounting bracket has a second clamping portion separated from said support by a second arm portion;

said second clamping portion being clamped to said second fuel injector in a position such that said second fuel injector is suspended in said second injector bore and capable of sliding a slight distance in and out of said second injector bore when said engine is running.

11. The noise reducing fuel injection system of claim 10 wherein said first arm portion is sufficiently flexible that said first fuel injector can slide a portion of said slight distance in and out of said first injector bore when said engine is running; and said second arm portion is sufficiently flexible that said second fuel injector can slide a portion of said slight distance in and out of said second injector bore when said engine is running.

12. The noise reducing fuel injection system of claim 11 wherein each of said first fuel injector and said second fuel injector each include at least one ring seal mounted thereon; and said at least one ring seal includes a carbon dam.

13. The noise reducing fuel injection system of claim 12 wherein said support is attached to said head with a fastener;

a first resilient member positioned between said head and said support; and a second resilient member positioned between said fastener and said support.

14. The noise reducing fuel injection system of claim 13 wherein said slight distance is less than about 0.2 millimeters.

15. The noise reducing fuel injection system of claim 14 further comprising a fluid rail with a first supply pipe attached to said first fuel injector with said first clamping portion and a second supply pipe attached to said second fuel injector with said second clamping portion;

said mounting bracket being attached to said fluid rail; and said fluid rail being attached to said head of said engine, but being isolated from said head by at least one resilient member.

16. The noise reducing fuel injection system of claim 15 wherein said first fuel injector is a first hydraulically actuated fuel injector with a first actuation fluid inlet open to said first supply pipe;

said second fuel injector is a second hydraulically actuated fuel injector with a second actuation fluid inlet open to said second supply pipe;

said fluid rail is a common fluid rail containing an actuation fluid, which is different from fuel, at a relatively high pressure.

17. A fuel injector mounting bracket comprising:

a support;

a first clamping portion sized to be clamped to a first fuel injector;

a first arm with one end attached to said support and an other end attached to said first clamping portion;

a second clamping portion sized to be clamped to a second fuel injector;

a second arm with one end attached to said support on an opposite side from said first arm, and an other end attached to said second clamping portion;

wherein said first clamping portion is sized to surround said first fuel injector and includes a first supply pipe connector; and said second clamping portion is sized to surround said second fuel injector and includes a second supply pipe connector.

18. The fuel injector mounting bracket of claim 17 further including extensions for attaching said mounting bracket to a fluid rail.

19. The fuel injector mounting bracket of claim 18 wherein said first arm is sufficiently flexible that said first fuel injector can move a slight distance with respect to said support when said support is attached to an engine and said engine is running; and said second arm is sufficiently flexible that said second fuel injector can move a slight distance with respect to said support when said support is attached to said engine and said engine is running.

* * * * *